US005423121A

United States Patent [19]

McElroy, II et al.

[11] Patent Number: 5,423,121

[45] Date of Patent: Jun. 13, 1995

[54] AUTOMATED FIN TUBE PROCESS

[75] Inventors: Arthur H. McElroy, II; James C. Calderwood; Chi K. Chim; Richard A. Deaver, all of Tulsa, Okla.

[73] Assignee: McElroy Manufacturing, Inc., Tulsa, Okla.

[21] Appl. No.: 182,455

[22] Filed: Jan. 18, 1994

[51] Int. Cl.[6] ..... B23P 15/26

[52] U.S. Cl. ..... 29/890.048; 29/726; 29/890.046; 29/890.053

[58] Field of Search ..... 29/726, 727, 890.048, 29/33 T, 33 R, 890.046, 890.053

[56] References Cited

U.S. PATENT DOCUMENTS 2,087,723 7/1937 McCord ..... 29/890.048
3,377,459 4/1968 Brown, Jr. et al. ..... 29/890.048
3,388,449 6/1968 McElroy .
3,500,903 3/1970 McElroy .
3,613,206 10/1971 McElroy .
3,789,786 2/1974 Wiedenmann et al. ..... 29/890.048
4,542,568 9/1985 Venable, III et al. ..... 29/727
4,969,255 11/1990 Schmidt et al. ..... 29/890.048

*Primary Examiner*—Irene Cuda
*Attorney, Agent, or Firm*—Head & Johnson

[57] ABSTRACT

A process to form a continuous fin helically around the exterior of a cylindrical tube by rotation of a primary forming roller and rotation of a contiguous spindle roller. The process includes advancing and inserting the fin in a gap between the primary forming roller and the spindle roller. The gap between the primary forming roller and the spindle roller is closed and the fin is tightly gripped therebetween. The tube is axially moved for a first, chosen length, while, at the same time, the tube is rotated at a first speed, the primary forming roller is rotated at a first speed and the spindle roller is rotated at a first speed. Thereafter, the tube is axially moved for a second, chosen length, while, at the same time, the tube is rotated at a second speed, the primary forming roller is rotated at a second speed, and the spindle roller is rotated at a second speed.

13 Claims, 5 Drawing Sheets

AUTOMATED FIN TUBE PROCESS

BACKGROUND OF THE INVENTION

1. Field of the Invention

The present invention is directed to a process and an apparatus to form a continuous fin helically around the exterior of a cylindrical tube.

2. Prior Art

The process and the apparatus to manufacture helically wound fin tubing is well known in the art. Examples in the prior art of fin tubing include the patents to A. H. McElroy, U.S. Pat. Nos. 3,388,449; 3,500,903; and 3,613,206. The resulting fin tube is utilized in heat transfer applications where a fluid or gas may be passed within and through the tube. Heat transfer is accomplished by transfer of heat through the fins. Fin tubing finds many applications from air conditioning units to refrigerators to many industrial applications.

It is known that if the fin is helically wound tightly around the tube, it will provide a good heat transfer surface without fastening, bonding or otherwise affixing the fin around the tube. It has been found, however, that in order to properly wind the fin to the tube, the first: few revolutions of the fin must be secure to the tube, otherwise, the remaining length of tubing will not be properly affixed thereto.

Existing solutions to this problem include stapling the first fin or few fins at the initial end of the tube or manually curling these initial fins tighter. Optionally, the last few fins at the end of the tube may also be pulled down or stapled to assure a tight fit.

These procedures require additional time and expense to secure the fin at the end of the tube and require additional human intervention and personnel to secure the first few revolutions of the fin to the tube.

Accordingly, there is a need to secure the initial revolutions of the fin to the tube without manually tightening the fins to the tube.

It has also been found that it is advisable to orient the primary forming roller and the spindle roller such that the tip of the fin is thinned in relation to the base of the fin. This promotes the curling of the fin around the tube during the metal forming process. At the same time, if the fin is curled too tightly, the end of the fin will buckle and wave.

Accordingly, there is a need to prevent buckling and waving of the end of the fin tube by controlling tightness of the fin to the tube.

SUMMARY OF THE INVENTION

The present invention provides a process and an apparatus to form a continuous fin helically around the exterior of a cylindrical tube. The cylindrical tube, of copper or other malleable material, may be unwound from a spool or coil and thereafter straightened and stretched into a cylindrical tube. The tube may be cut to desired lengths and then positioned to begin the finning process. The tube is positioned with its downstream end projecting through a tube guide or bridge adjacent to the metal forming mechanism.

While the bare tube is proceeding through the foregoing procedure or thereafter, flat fin stock is both advanced and formed into an L-shape. The fin stock is advanced by a pair of driving gears, driven by a continuous belt. The continuous belt may be driven by a shaft extending from a pulley which is engaged with a motor shaft of a fin stepper motor by a drive belt. The action of the stepper motor will, thus, advance the fin stock strip up and into a gap or space created between a primary forming roller and a spindle roller. A pair of driving rollers serve to form the fin stock from a flat orientation to a 90° angle having a foot and a vertically extending leg.

The primary forming roller is normally in a default position slightly apart or moved away from the spindle roller to provide a gap therebetween. The primary forming roller, mounted on a frame, is attached to a primary forming roller shaft which is driven by motor "W". The frame is connected to an actuator which is normally in the retracted position. When the actuator extends, the primary forming roller moves and closes the gap between the primary forming roller and the spindle roller. When the fin has been inserted into the gap, the fin will be tightly wedged between the primary; forming roller and the spindle roller.

Each of four motors, "W", "X", "Y" and "Z", is thereafter initiated. The "Y" motor is connected to a conveyor which is, in turn, connected to the cylindrical tube so that movement of the conveyor moves the tube axially. The "X" motor is mounted on the conveyor and is attached to the tube. The "X" motor rotates the tube so that the tube spins about its axis.

The spindle has an extending shaft which extends through a spindle frame. The spindle shaft is rotated by the spindle motor or "Z" motor. Its motion is expressed in a number of revolutions.

Finally, the "W" motor rotates the primary forming roller.

While the "Y" motor axially advances the tubing stock, the "X" motor rotates the tubing stock. Simultaneously, the "W" motor of the primary forming roller and the "Z" motor of the spindle roller advance and form the fin into a curl which moves around the exterior of the tube.

In order to secure the fin to the tube, an initial number of revolutions of the fin will be curled tighter than the balance or majority of the fins on the tube. Thereafter, the fin will be wound at an average tightness around the tube defined as the normal or nominal speed. During the nominal speed, the peripheral speed of the spindle head to the peripheral speed of the primary forming roller is 1.1:1. During the initial finning operation, the peripheral speed of the "Z" axis is 1.2 times the speed of the "W" axis. Moving from the tighter curl to the normal curl, the speed of the "Z" motor may be reduced with respect to the "W" motor. Alternatively, the speed of the "W" motor may be increased with respect to the speed of the "Z" motor.

In the present arrangement, the relative speeds are all calculated and controlled in relation to the "Y" movement.

DETAILED DESCRIPTION OF THE PREFERRED EMBODIMENT

Figure 1:
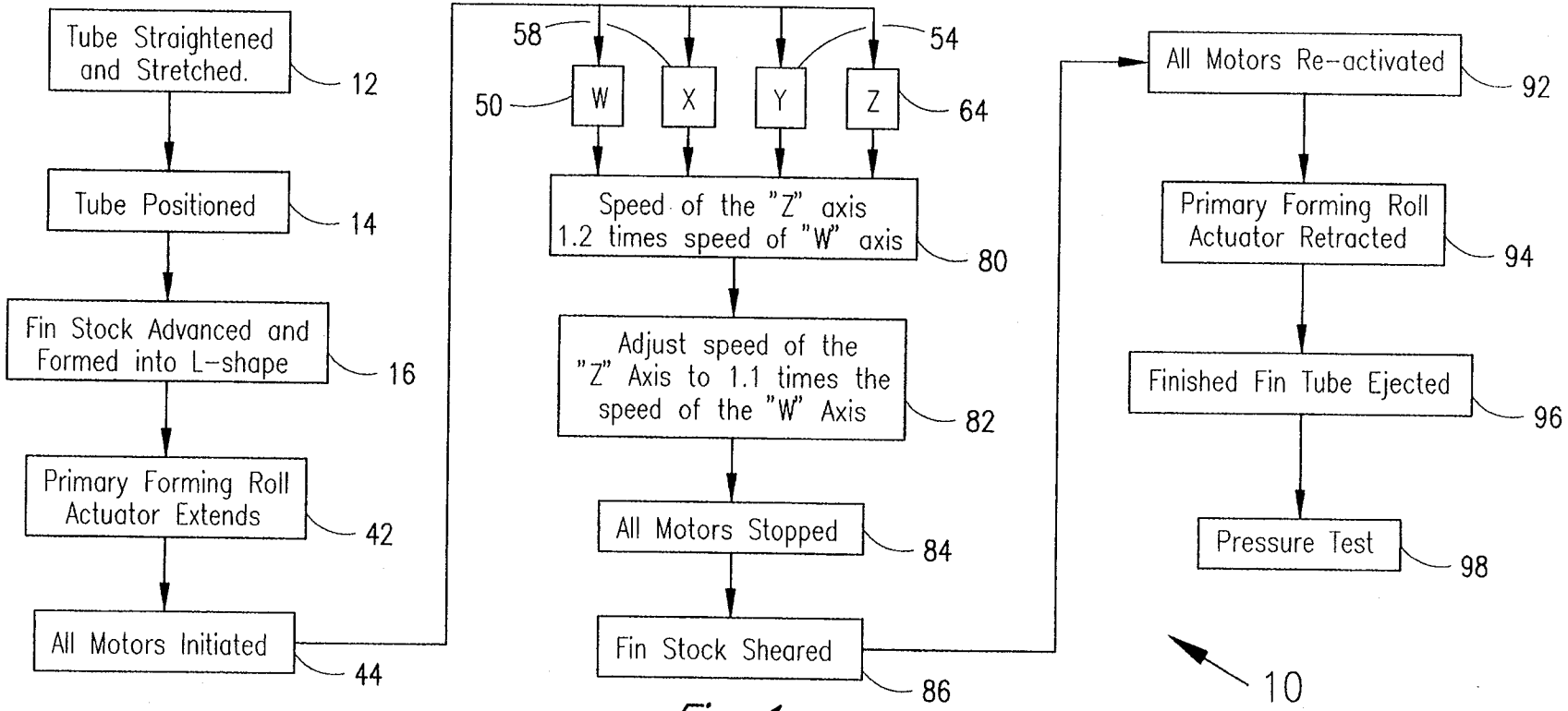
FIG. 1 is a flow chart diagram illustrating the steps of the process to form a continuous fin helically around the exterior of a cylindrical tube.

Referring to the drawings in detail, FIG. 1 is a flow chart block diagram illustrating the steps and processes embodied in one particular embodiment of the present invention 10.

The cylindrical tubing used to form the fin tube may be copper or other malleable metal and may initially be wound on a large spool or coil (not shown). As shown at box 12, the tubing may be unwound from the spool or coil and, thereafter, pulled through a straightening roller or series of rollers. The tube is then clamped at each end and stretched to straighten it into a cylinder.

Finally, the tube may be cut to a desired length. In one arrangement, the tube is cut from 90" to 20 foot lengths.

During the next stage, the cylindrical tube is positioned to begin the finning process as illustrated at box 14. The bare tube, which has been cut and straightened, is then dropped or dumped onto a holding rack. A proximity sensor may be located at the base of the rack to sense the presence of a tube.

The bare tube is thereafter moved from the rack and loaded into a barrel by a capstan drive which moves the tube longitudinally. The barrel contains an input barrel rack which holds two tubes, one in the loading position and one in the finning position. The rack holds a tube in the loading position prior to the beginning of the finning operation. Once a tube is inserted, the input barrel is then rotated 180° from the loading position to the finning position.

It will be appreciated that by rotating the barrel, one tube can be loading while the other is in the finning process.

Thereafter, the input barrel moves axially so that the bare tube is positioned with its downstream end projecting through a tube guide or bridge which is adjacent to the metal forming mechanism to be discussed in detail. A collet or other similar device will engage then downstream end of the tube. A "Y" motor (to be discussed in detail herein) will then move the tube axially a short distance. This distance is referred to as the "strip back" which is used for connections, such as solder connections, when the fin tube is finally employed. Typically, the strip back may vary from ½ inch to six inches.

Figures 2, 3:
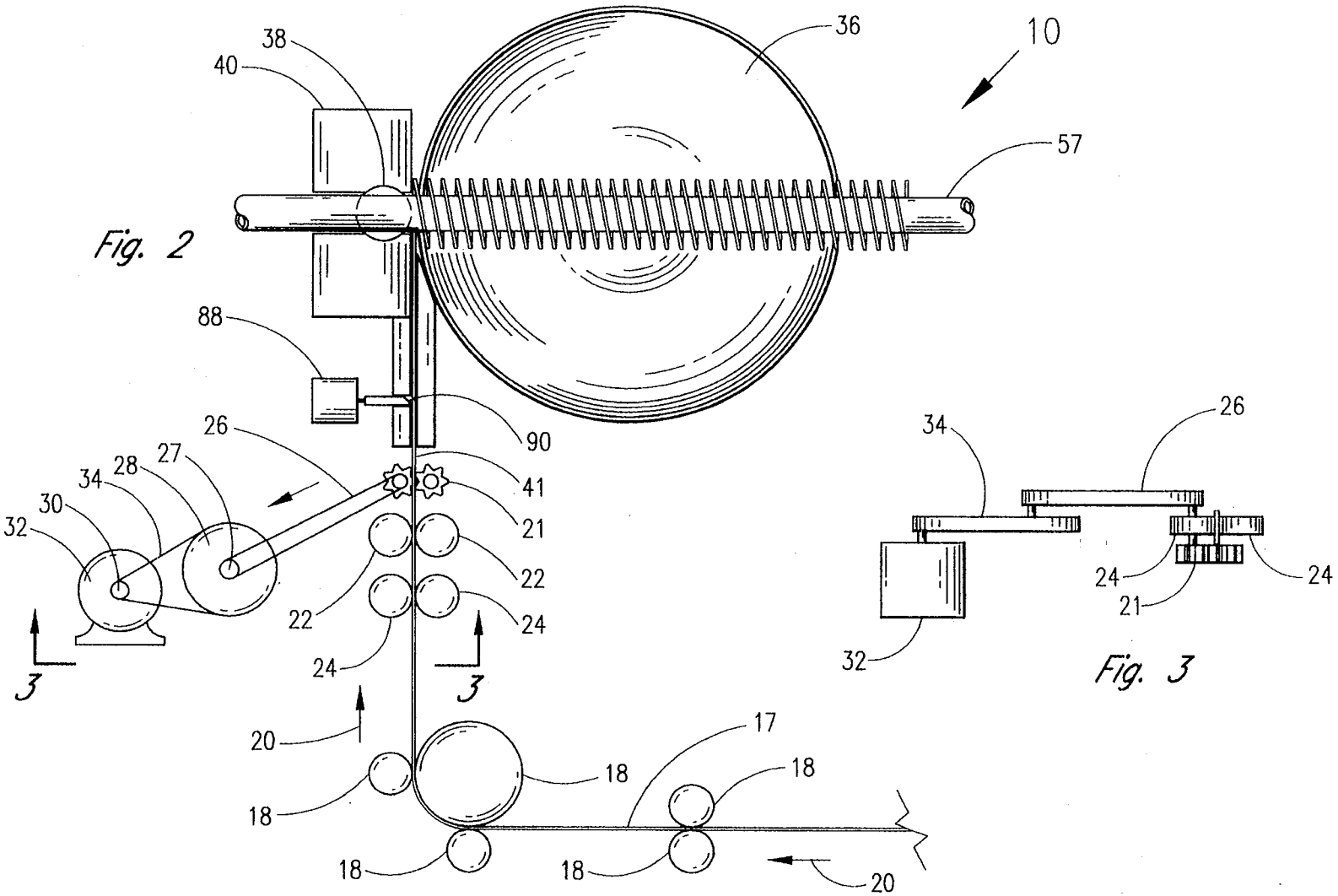
FIG. 2 is a perspective view of a portion of the process and apparatus to form a continuous fin helically described in FIG. 1.
FIG. 3 is a sectional view taken along section lines 3—3 of FIG. 2.

While the bare tube is proceeding through the foregoing procedure or thereafter, the fin stock is then both advanced and formed into an L-shape, as shown at box 16. This step is illustrated in FIGS. 2 and 3. The flat metal fin stock 17 may be supplied from a large roll (not shown in FIGS. 2 and 3) and then delivered through a series of free rollers 18 so that the fin stock moves in the direction of the arrows 20.

Thereafter, a pair of gears 21 will advance the fin stock 17. The gears are driven by a continuous belt 26 which rotates the rollers. The continuous belt may be driven by a shaft 27 extending from a pulley 28. The pulley 28 is engaged with a motor shaft 30 of a fin stepper motor 32 by a drive belt 34.

A pneumatic cylinder (not shown) is used to pinch together or separate the gears 21.

The action of the stepper motor 32 will, thus, advance the fin stock strip 17 up to and through a gap or space created between a primary forming roller 36 and a spindle roller 38 (shown by dashed lines in FIG. 2). The sole function of the fin stepper motor is to perform this function.

A bridge or tube guide 40 is adjacent to the spindle roller 38 and the primary forming roller (not shown).

During operation, as will be described herein, the primary forming roller is contiguous with the spindle roller and they work together to form the fin stock to the desired shape and helical configuration. The primary forming roller may be angularly oriented to the spindle roller.

The driving rollers 22 and 24 serve the function of forming rollers. The forming is done in two stages. As the fin stock 17 enters and passes through the first set of rollers 24, the fin stock is formed from and changed from flat stock to an approximately 45° angle.

By movement through and past the second set of rollers 22, the 45° angle is thereafter changed. A 90° angle is placed in the fin stock. Accordingly, the flat fin stock 17 is formed into an L-shaped fin 41 having a short foot and a vertically extending leg. When completed, the short foot will be against the exterior of the tube and the leg will extend vertically therefrom.

It will be appreciated that although the present embodiment utilizes an L-shaped fin, other fin designs may also be employed within the spirit of the invention.

The fin stepper motor 32 through its connection with the pulley 28, will drive the fin stock 17 up to the gap between the primary forming roller and the spindle roller. As will be described herein, the fin strip is pulled and extruded from the forming roller and spindle roller by movement of the rollers. The stock is not driven by the fin stepper motor 32.

Returning to a consideration of FIG. 2, the primary forming roller 36 is normally in a default position slightly apart or moved away from the spindle roller 38 to form a gap therebetween.

Figure 4:
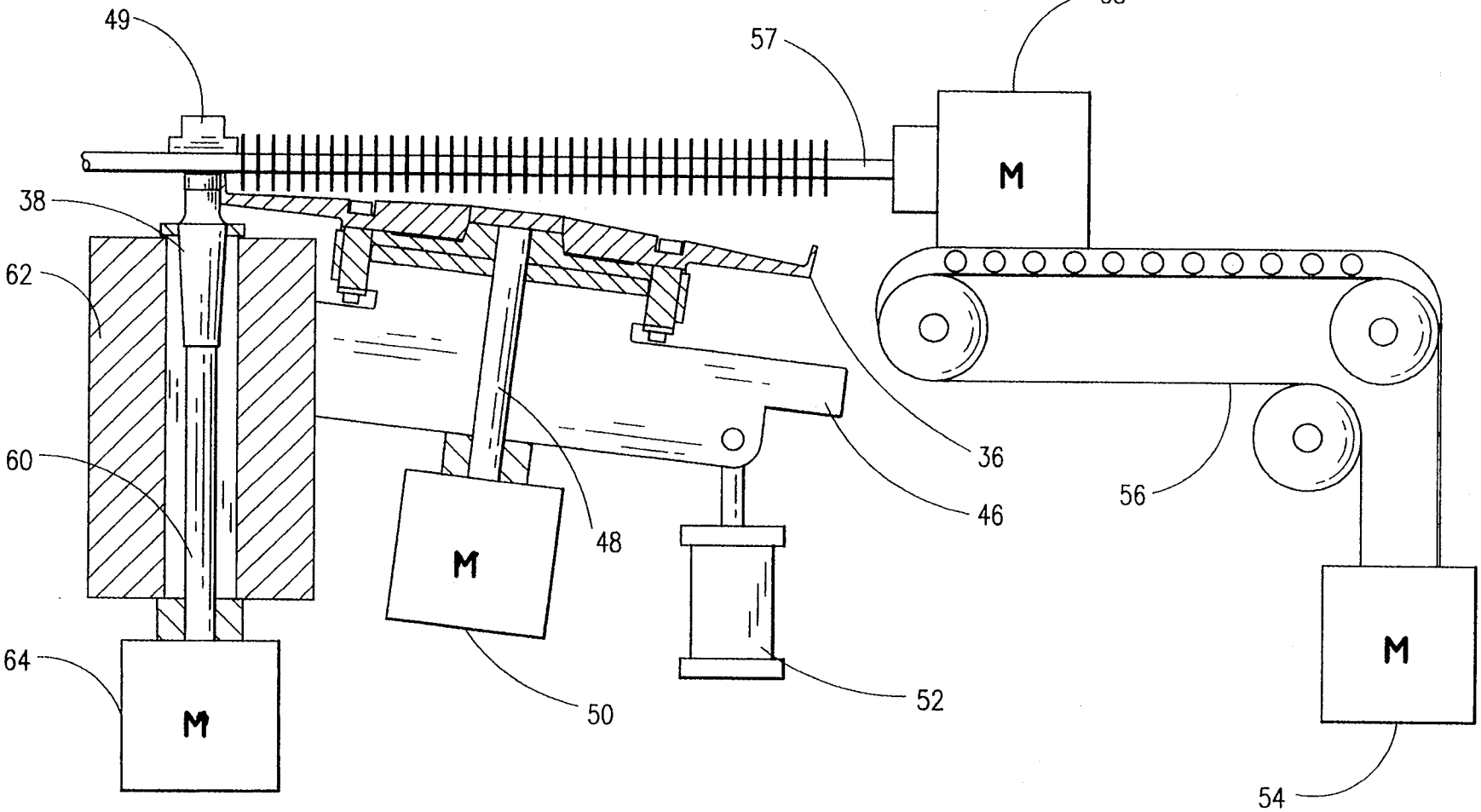
FIG. 4 is a diagrammatic representation of a portion of the process and apparatus, as shown in FIG. 1.

FIG. 4 is a simplified representation of the fin forming mechanism. The primary forming roller 36 is mounted on a frame 46. The primary forming roller 36 is attached to a primary forming roller shaft 48 which is driven by a motor 50. The motor will be referred to as the "W" motor to indicate the rotational movement of the primary forming roller 36.

The frame 46 is connected to an actuator 52. The actuator is normally in the retracted position. When the actuator 52 of the primary forming roller frame 46 extends, the primary forming roller 36 moves and closes the gap between the primary forming roller 36 and the spindle roller 38. When the fin 41 has been inserted in the gap between the primary forming roller 36 and the spindle roller 38, the fin will be tightly wedged therebetween. This step is illustrated in FIG. 1 at box 42.

The next step in the process is illustrated at box 44 wherein each of four motors to be described—W, X, Y and Z—is initiated. The four motors are illustrated diagrammatically in FIG. 4. The "Y" motor 54 is connected to a conveyor 56 which is, in turn, connected to the cylindrical tube 57 so that movement of the conveyor 56 moves the tube 57 longitudinally or axially. As will be described in detail herein, the "Y" motor and its movement (sometimes referred to as the "Y" axis) is the master reference or master axis and the other movements to be described herein are determined with reference thereto.

The "X" motor 58 is mounted on the conveyor 56 so that movement of the "Y" motor transports the "X" motor. The "X" motor is attached to the tube 57 and acts as the connection for the "Y" motor. The "X" motor serves to rotate the tube 57 so that the tube spins about its axis. This rotational tube drive will sometimes be referred to herein as the "X" movement or "X" axis. Its motion will be expressed in a number of revolutions.

The spindle 38 has an extending shaft 60 which extends through a spindle frame 62. The spindle shaft 60 is rotated by a spindle motor 64. The movement of the spindle motor 64 is referred to as the "Z" movement or "Z" axis. Its motion is expressed in a number of revolutions.

Finally, the "W" motor 50 rotates the primary forming roller 36. In the present .embodiment, each of these motors is a Servo motor which may be controlled and varied. Other types of motors are, of course, possible within the parameters of the invention.

While the "Y" motor axially advances the tubing stock 57, the "X" motor will rotate the tubing stock. Simultaneously, the "W" motor of the primary forming roller 36 and the "Z" motor of the spindle roller 38 advance and form the fin into a curl which moves around the exterior of the tube. These motions may be summarized as follows:

| SERVO MOTORS | |
|---|---|
| Linear Tube Drive (Y-axis) | Master Reference Axis - motion expressed in inches |
| Rotational Tube Drive (X-axis) | Slave Axis - motion expressed in number of revolutions |
| Spindle Drive (Z-axis) | Slave Axis - motion expressed in member of revolutions |
| Pan Drive (W-axis) | Slave Axis - motion expressed in number of revolutions |

The relationship between the four drive motors and their rotations may be observed. For every inch that "Y" moves, "X" will move a number of revolutions which may be described in terms of fins-per-inch. This is the relationship of "X" to "Y".

There is also a relationship between the rotational tube drive and the primary forming roller drive "W". For every revolution "X" makes, "W" will make a number of revolutions This ratio expresses the relationship between the circumference of the tube and the circumference of the primary forming roll. In one example, for each revolution "X" makes, "W" makes 0.0597 revolutions. Since circumference equals $\pi$ times the diameter, the ratio expresses the relationship between the diameters of the rotational tube drive "X" and the pan drive "W" as such:

There is also a relationship between the primary forming roller drive "W" and the spindle drive "Z". For every revolution "W" makes, "Z" will make a number of revolutions. This relationship is called the primary forming roller to spindle ratio.

In one example, for every revolution "W" makes, "Z" will make approximately 17 revolutions during its normal or nominal speed. This relationship also may be defined as the relationship between the diameter of the primary forming roll and the diameter of the spindle roller:

$$\frac{\pi d_w}{\pi D_z}$$

Figure 5:
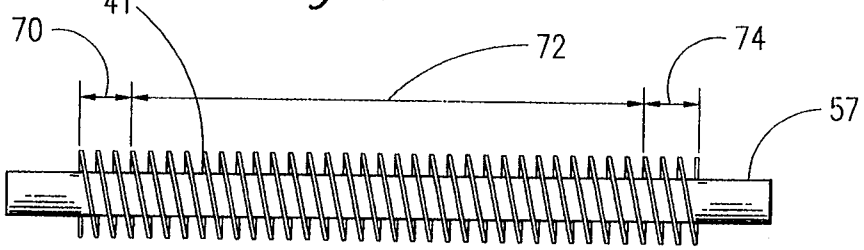
FIG. 5 is a perspective view of a completed fin tube constructed in accordance with the present invention.

In order to secure the fin to the tube 57, an initial number of revolutions of the fin will be curled tighter than the balance or majority of the fins on the tube. A completed fin tube is illustrated in FIG. 5. After provision for the strip back, an initial number of fins are wrapped tightly around the tube, as illustrated by the distance shown by arrow 70. Thereafter, the fin will be wound at an average tightness around the tube as shown by the axial distance illustrated by arrow 72. This is the normal or nominal operating condition.

Optionally, the last number of fin revolutions may also be at a tighter than normal rate. This is illustrated by the distance shown in arrow 74. The movement of the motors during the distance 72 is referred to as the normal or nominal speed. The distances 70 and 74 are at a different speed and will wrap the fins tighter around the tube. The strip back on each end of the tube is also illustrated in FIG. 5.

The normal or nominal speed will be described first and may be illustrated by an example. In order to make a fin tube having a length of 100 inches, a one inch strip back at each end, and a pitch or number of fins of 10.5 fins-per-inch, the following will occur. Taking into account the strip backs, the linear tube drive or Y-motor 54 is commanded to move a total of 98 inches axially or lengthwise. The slave axes, X, Z and W, are commanded to follow Y. For each inch that Y moves the tube, X moves the tube 10.5 revolutions, resulting in a pitch of 10.5 fins-per-inch. For every inch Y moves, W will move 10.5 revolutions multiplied by 0.0597. As will be observed, the Y axis is the reference axis or reference speed with the other three movements corresponding to the movements of Y. During this operation, the four motors axially advance and rotate the tubing stock while simultaneously preforming the fin strip into an L-shape and forming and wrapping it tightly around the tubing.

It is known that the relationship between W, the primary forming roller drive, and Z, the spindle drive, plays an important part in the tightness of the curl of the fin. As an example, if the spindle head were operating at the same peripheral speed of the primary forming roller the ratio between them would be 1:1. During the normal finning operation, the ratio of the spindle to the primary forming roller is 1.1:1. This difference in their relative speed is known to encourage and produce curling of the fin as it exits the forming rollers. During the initial and final finning operation (as shown at arrows 70 and 74) the speed of the Z axis is approximately 1.2 times the speed of the W axis. This step in the process is shown at box 80.

After an initial number of fins are applied during the distance shown by arrow 70 in FIG. 5, the speed of the motors will be adjusted to the normal finning operation.

As shown at box 82, the speed of the Z axis will be adjusted to 1.1 times the speed of the W axis. This will result in the normally tight curl of the fin around the tube, which is less tight than the initial curl of the fin around the tube.

Moving from the tighter curl to the normal curl may be accomplished in a number of ways. The speed of the Z motor may be reduced with respect to the W motor.

Alternatively, the speed of the W motor may be increased with respect to the speed of the Z motor.

In the present arrangement, the relative speeds are calculated and controlled in relation to Y movement. During the normal or nominal speed, the Y to W ratio is 0.537. In other words, for each inch of Y movement, W moves 0.537 revolutions. During the tighter, initial finning operation, W moves 0.510 revolutions. The W to Z ratio moves from 17 to 19. Finally, the Y to Z ratio moves from 9.129 to 9.67. As follows:

| Motor | Normal Run | Tight Run |
|---|---|---|
| Y to W | 0.537 | 0.510 |
| W to Z | 17 | 19 |
| Y to Z | 9.129 | 9.69 |

From the foregoing, it can be appreciated that a two-phase finning operation is quickly and simply accomplished.

Returning to a consideration of FIGS. 2, 3, and 4, the application of the fin to the tube is performed by the movement of the primary forming roller and the spindle roller. As described, during the metal forming operation, the fin stepper motor 32 is not operational. The movement of the primary forming roller and spindle roller pulls the fin stock 17 up to the forming area and wraps the fin around the tubing.

Returning to a consideration of FIG. 1, near the end of the desired length of tubing (prior to a total "Y" movement of 98 inches during the finning process), all four of the motors will be stopped, as shown at box 84. In other words, all four of the motors will be stopped after the Y motor has moved the tube axially a predetermined length. Thereafter, the fin stock will be sheared, shown at box 86.

Referring back to FIG. 2, a fin shear mechanism includes an extending blade 90, extending from an actuator 88. The fin stock is cut in front of or advance of the spindle roller and contiguous primary forming roller by movement of the actuator 88. Once the fin stock has been sheared, all four of the motors—W, X, Y and Z—are reactivated so that the finning operation continues for the length of the fin between the primary forming roller/spindle roller and the blade 90. This step is indicated at box 92 in FIG. 1. The finning operation will continue until the remainder of the fin is applied to the tube. Optionally, the final finning operation may be performed at the 1.2 to 1 ratio to produce a tighter curl at the end.

In one example, approximately six and one-half rotations of fin will be made around the tube to complete the operation. The primary forming roller and spindle roller will then be stopped just before the end of the fin strip leaves the forming roller/spindle roller.

The next step of the operation is indicated at box 94 wherein the actuator 52 is retracted. The actuator 52 on the primary forming roller or pan is retracted thereby withdrawing the primary forming roller away from the spindle roller and providing the gap therebetween. The actuator 52 retains the primary forming roller 36 away from the spindle in the default position until a new sequence begins.

After the gap is opened, the Y axis and X axis continue for a short period in order to eject the tube.

Finally, a number of additional optional steps may be performed. As shown at box 96, the finished fin tube is ejected. The Y motor 54 moves the finished fin tube axially to a dumping position. The collet, not shown, holds the tube to the X motor, and releases the tube. The tube is then separated from the collet and moved by a conveyor to be swaged as shown at box 97.

Finally, optional procedures may be performed such as a pressure test shown at box 98. Air under pressure is injected into the tube and a sensor is used to detect any leaks in the tube.

An additional feature has been combined with the present invention. It has been observed that at the initial stage and optionally, at the end, where the fin tube is curled tightly to the tube, the ends of the fin tend to wave or buckle. In other words, the tighter the fin is wrapped around the tube, the more waving or buckling of the fin is promoted. This problem is exacerbated because the fin gets thinner at its end than at its base. A solution to this problem has been found by redesigning the standard cylindrical spindle roller.

Figure 6:
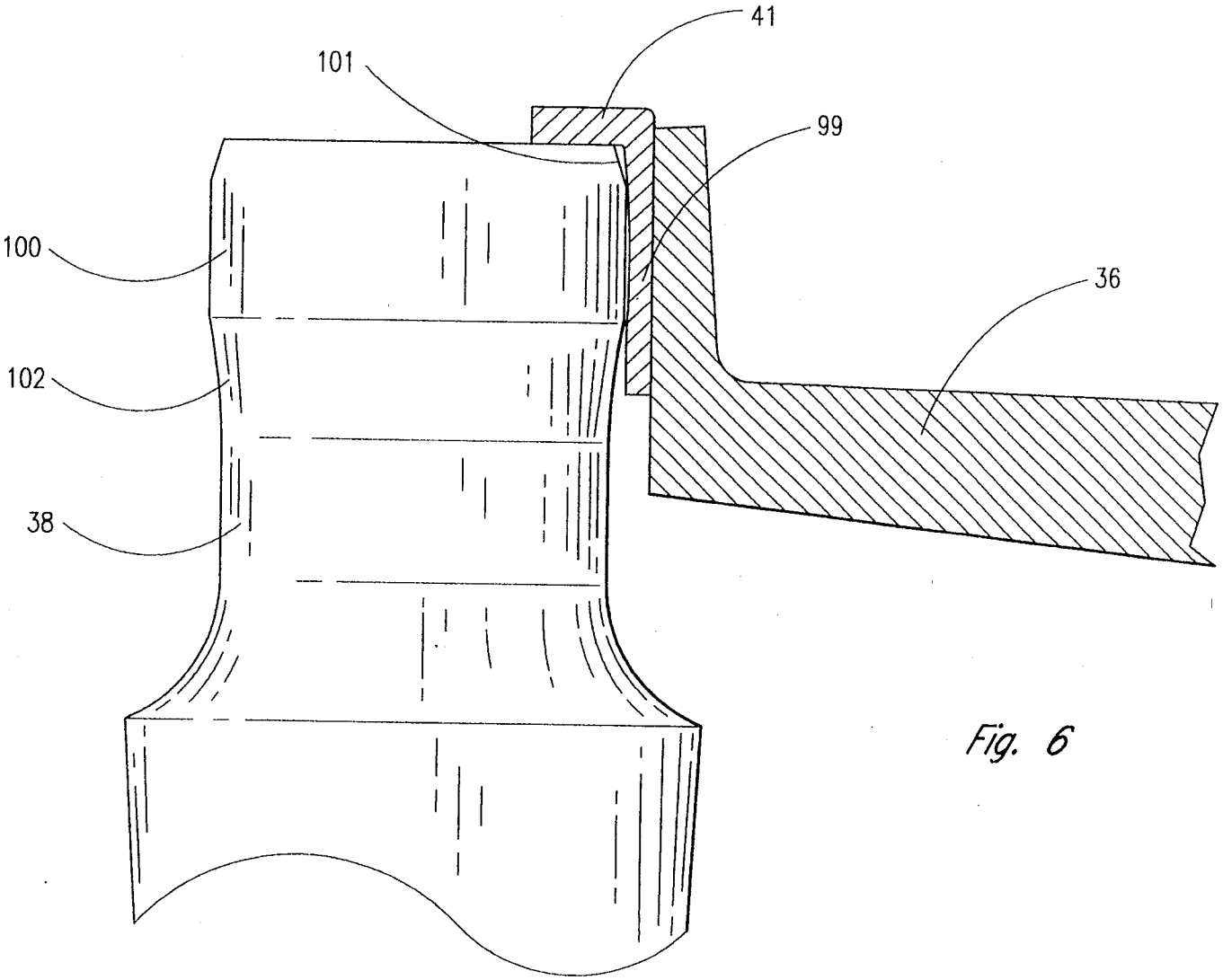
FIG. 6 is an enlarged view of the spindle head and primary forming roller utilized in the process and apparatus as set forth in FIG. 1.

FIG. 6 is an enlarged view of the spindle head 38 along with a cross-section of the primary forming roller 36. The fin 41 being formed is shown in cross-section therebetween. The fin has an L-shape with a shorter foot at the top and a tapered vertically extending leg 99.

The primary forming roller is angularly oriented to the axis of the spindle roller. The spindle roller has a first upper surface 100 which is substantially cylindrical. The first upper surface may also have a chamfered end 101 closest to the foot.

Adjacent to the upper surface of the spindle roller is a lower surface 102 which is gradually tapered in from the larger diameter to a reduced diameter. The lower surface portion of the spindle roller has a curved convex profile. The combination of the upper surface 100 and the lower surface 101 of the spindle roller acts to form a fin having a lower portion adjacent the foot and adjacent the tube, and an upper portion extending therefrom. Historically, the vertically extending leg of the fin has had essentially a straight taper from base to the tip. It has been found and demonstrated that altering the otherwise cylindrical shape of the spindle roller, forms a fin leg that is thicker at the base but does not overly thin at the end, causing waving or buckling.

In summary, the design of the spindle roller allows the fin to be wrapped at a desired tightness while avoiding waving or buckling at the end of the fin.

Figure 7:
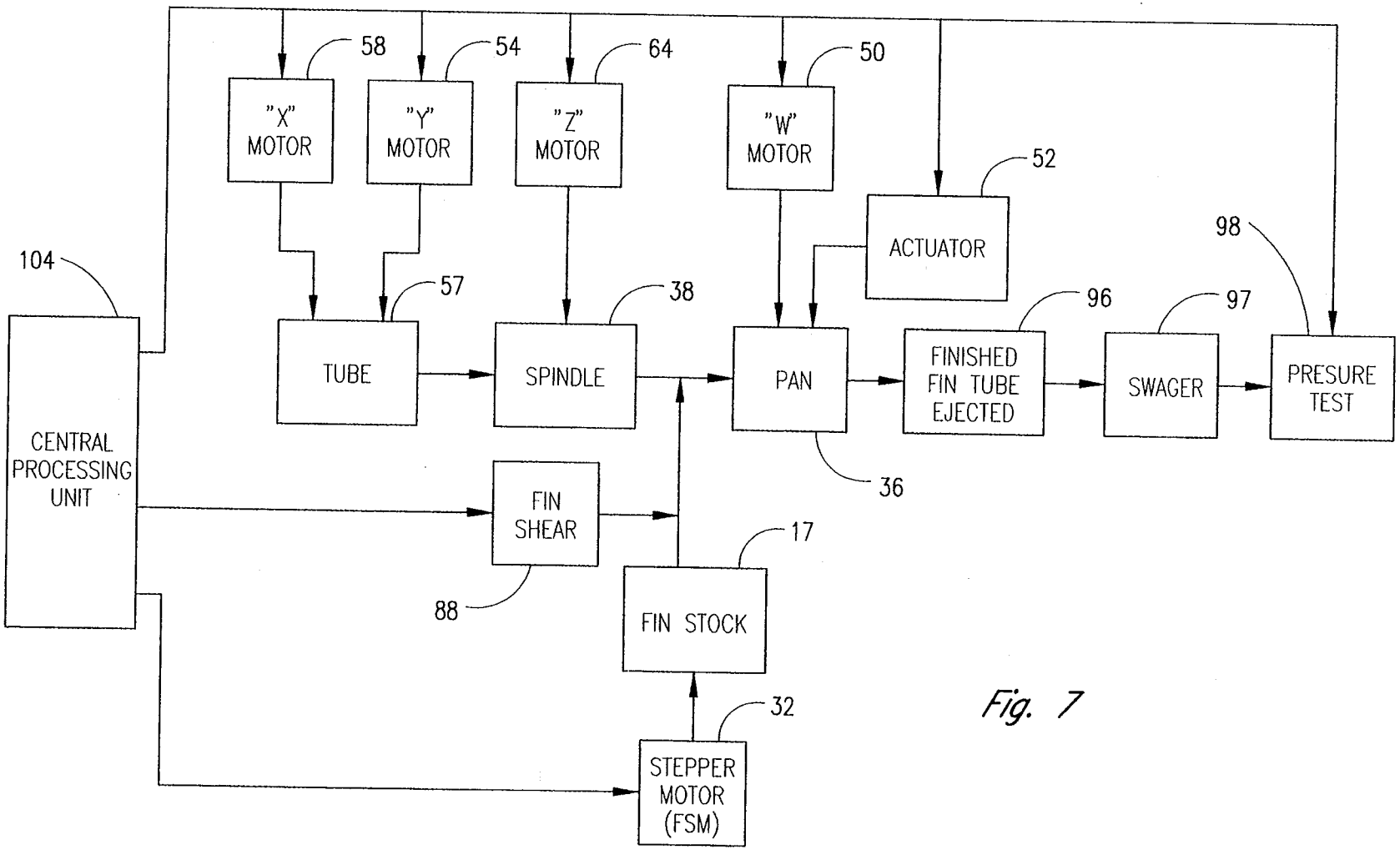
FIG. 7 is a block diagram illustrating the relationship of the various elements of the automated fin tube process and apparatus as set forth in FIG. 1.

FIG. 7 is a block diagram showing the relationship of the motors, the forming rollers and the fin shear. Each element is monitored and controlled by the central processing unit 104. The X, Y, Z and W motors are each connected to the central processing unit. The speed of each motor is monitored and controlled several times per second. As an example, as the Y motor increases in speed, the remaining motor will increase in speed to maintain the proportional relationship.

The foregoing process may thereafter be repeated quickly and efficiently with a minimum of human assistance and intervention.

Whereas, the present invention has been described in relation to the drawings attached hereto, it should be understood that other and further modifications, apart from those shown or suggested herein, may be made within the spirit and scope of this invention.

What is claimed is:

1. A process to form a continuous fin helically around the exterior of a cylindrical tube by rotation of a primary forming roller and rotation of a contiguous spindle roller, which method comprises:

a) advancing said fin from a fin source and inserting said fin in a gap between said primary forming roller and said spindle roller;

b) closing said gap between said primary forming roller and said spindle roller and tightly gripping said fin therebetween;

c) axially moving said tube fox a first, chosen length while, at the same time, rotating said tube at a first speed, rotating said primary forming roller at a first speed, and rotating said spindle roller at a first speed; and d) axially moving said tube for a second, chosen length while, at the same time, rotating said tube at a second speed, rotating said primary forming roller at a second speed, and rotating said spindle roller at a second speed.

2. A process to form a continuous fin helically around the exterior of a cylindrical tube as set forth in claim 1 wherein said fin is advanced and inserted in said gap by fin stock motor means and gear means.

3. A process to form a continuous fin helically around the exterior of a cylindrical tube as set forth in claim 1 including the additional step of preforming said fin stock in an L-shape cross-section prior to closing said gap and tightly gripping said fin.

4. A process to form a continuous fin helically around the exterior of a cylindrical tube as set forth in claim 4 wherein two pairs of forming rollers are employed to preform said fin stock.

5. A process to form a continuous fin helically around the exterior of a cylindrical tube as set forth in claim 1 including the additional, initial steps of straightening said tube by passing through straightening rollers, stretching said tube, and thereafter positioning the tube in relation to said spindle roller.

6. A process to form a continuous fin helically around the exterior of a cylindrical tube as set forth in claim 1 including extending an actuator to move said primary forming roller to close said gap between said primary forming roller and said spindle roller.

7. A process to form a continuous fin helically around the exterior of a cylindrical tube as set forth in claim 1 including the additional steps of:

monitoring and controlling the axial movement of said tube, monitoring and controlling said rotation of said tube, monitoring and controlling said rotation of said primary forming roller, and monitoring and controlling said rotation of said spindle roller with a central processing unit.

8. A process to form a continuous fin helically around the exterior of a cylindrical tube as set forth in claim 1 wherein the peripheral speed of said spindle roller at said first speed is approximately 1.2 times the peripheral speed of said primary forming roller at said first speed.

9. A process to form a continuous fin helically around the exterior of a cylindrical tube as set forth in claim 1 wherein the peripheral speed of said spindle roller at said second speed is 1.1 times the peripheral speed of said primary forming roller at said second speed.

10. A process to form a continuous fin helically around the exterior of cylindrical tube as set forth in claim 1 including the additional step of axially moving said tube for a third, chosen length while, at the same time, rotating said tube at said first speed, rotating said primary forming roller at a first speed, and rotating said spindle roller at a first speed.

11. A process to form a continuous fin helically around the exterior of a cylindrical tube as set forth in claim 1 wherein said continuous fin is formed having a lower portion adjacent said tube, a reduced thickness end portion extending from said lower portion.

12. A process to form a continuous fin helically around the exterior of a cylindrical tube as set forth in claim 1 including the additional steps of:

a) stopping axial movement of the tube, stopping rotation of said tube, stopping rotation of said primary forming roller, and stopping rotation of said spindle roller after said second length;

b) shearing said fin stock in advance of said primary forming roller and spindle roller; and c) thereafter reactivating said axial movement of said tube, reactivating said rotating of said tube, reactivating said rotating of said primary forming roller, and reactivating said rotating of said spindle roller to form the remainder of said fin around said tube.

13. A process to form a continuous fin helically around the exterior of a cylindrical tube as set forth in claim 12 including the additional steps of:

ejecting the finished fin tube; and pressure testing said finished fin tube for leaks.

* * * * *

UNITED STATES PATENT AND TRADEMARK OFFICE

CERTIFICATE OF CORRECTION

PATENT NO. : 5,423,121

DATED : June 13, 1995

INVENTOR(S) : Arthur H. McElroy, II; James C. Calderwood; Chi K. Chin and Richard A. Deaver It is certified that error appears in the above-indentified patent and that said Letters Patent is hereby corrected as shown below:

On the title page:

Item: [75], Line 2, "Chim" should be --Chin--.

Signed and Sealed this

Fifth Day of November, 1996

*Attest:*

Bruce Lehman

BRUCE LEHMAN

*Attesting Officer*

*Commissioner of Patents and Trademarks*